US009614317B2

(12) United States Patent
Yoshigi et al.

(10) Patent No.: US 9,614,317 B2
(45) Date of Patent: Apr. 4, 2017

(54) CONNECTOR SUPPORT STRUCTURE AND ADAPTOR

(71) Applicant: Yazaki Corporation, Minato-ku, Tokyo (JP)

(72) Inventors: Toshimasa Yoshigi, Makinohara (JP); Hironaga Iwamoto, Fujieda (JP); Kiyotaka Mizuno, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/947,066

(22) Filed: Nov. 20, 2015

(65) Prior Publication Data

US 2016/0149333 A1 May 26, 2016

(30) Foreign Application Priority Data

Nov. 21, 2014 (JP) ..... 2014-237066

(51) Int. Cl.
*H01R 13/64* (2006.01)
*H01R 13/516* (2006.01)
*H01R 13/506* (2006.01)

(52) U.S. Cl.
CPC ..... *H01R 13/516* (2013.01); *H01R 13/506* (2013.01); *H01R 2201/26* (2013.01)

(58) Field of Classification Search
CPC .. H01R 13/502; H01R 13/516; H01R 13/506; H01R 2201/26
USPC ..... 439/660, 248, 247, 34
See application file for complete search history.

(56) References Cited

U.S. PATENT DOCUMENTS 5,876,228 A * 3/1999 Hayashi ..... H01R 13/6315 439/248
6,139,346 A 10/2000 Cecil, Jr. et al.

FOREIGN PATENT DOCUMENTS

| | | | |
|---|---|---|---|
| JP | 1-121278 | U | 8/1989 |
| JP | 2000-348829 | A | 12/2000 |
| JP | 2014-26907 | A | 2/2014 |
| JP | 2014-82899 | A | 5/2014 |

OTHER PUBLICATIONS

Communication issued Dec. 13, 2016, issued by the Japanese Patent Office in counterpart Japanese Patent Application No. 2014-237066.

* cited by examiner

*Primary Examiner* — Javaid Nasri
(74) *Attorney, Agent, or Firm* — Sughrue Mion, PLLC

(57) ABSTRACT

A connector support structure includes: a connector fitted to a counterpart connector formed in an electric component; a connector support portion formed in a wiring board in which an electric wire to be connected to the connector is arranged; and a resin adaptor which holds the connector internally and which is inserted into and supported by the connector support portion. The adaptor includes a plurality of elastic pieces in an outer circumferential surface of the adapter such that the connector is supported on an inner surface of the connector support portion through the elastic pieces.

4 Claims, 13 Drawing Sheets

CONNECTOR SUPPORT STRUCTURE AND ADAPTOR

CROSS REFERENCE TO RELATED APPLICATION(S)

This application is based on and claims priority from Japanese Patent Application (Application No. 2014-237066) filed on Nov. 21, 2014, the entire contents of which are incorporated herein by reference.

BACKGROUND

1. Field of the Invention

One or more embodiments of the present invention relate to a connector support structure and an adaptor for use in the connector support structure.

2. Description of the Related Art

An electric component such as a solenoid valve (hereinafter referred to as electric component) is mounted on a transmission or the like in a car. In order to supply an electric signal or a power source to such an electric component, a connector connected to a signal line or a power supply line (hereinafter referred to as electric wire simply) is fitted to a counterpart connector provided in the electric component.

However, when connectors connected to electric wires are connected to counterpart connectors of a plurality of electric components, respectively, the number of working steps increases to increase the cost. Therefore, there has been disclosed a structure in which a plurality of connectors are retained on a wiring board where electric wires connected to the connectors have been arranged, and the connectors are connected to electric components, respectively (see JP-A-2014-26907).

According to JP-A-2014-26907, a base end portion of each connector is inserted into and supported by a through hole formed in a side surface of the wiring board, and a distal end portion of the connector is fitted to a counterpart connector of an electric component. In this manner, a plurality of connectors supported on the wiring board can be connected to counterpart connectors of electric components, respectively.

SUMMARY

However, when a base end portion of each connector is supported in a through hole of a wiring board as in JP-A-2014-26907, a clearance is formed between the through hole and the base end portion of the connector. Accordingly, misalignment may occur between the position of each connector and the position of a counterpart connector of an corresponding electric component. As a result, even when the center of one connector is aligned with the center of a corresponding counterpart connector, the center of another connector may be displaced from the center of a corresponding counterpart connector. Thus, there is a problem that connection between each connector and each counterpart connector becomes troublesome.

An object of one or more embodiments of the invention is to easily perform connection work between each connector supported on a wiring board and each counterpart connector to thereby enhance working efficiency.

In an aspect of the invention, a connector support structure includes: a cylindrical connector to be fitted to a counterpart connector formed in an electric component; a cylindrical connector support portion formed in a wiring board in which an electric wire to be connected to the connector is arranged; and a resin adaptor which holds the connector internally and which is inserted into and supported by the connector support portion, wherein the adaptor includes a plurality of elastic pieces in an outer circumferential surface of the adapter such that the connector is supported on an inner surface of the connector support portion through the elastic pieces.

With this configuration, even when misalignment occurs between the connector and the counterpart connector, the distal end portion of the connector is caught by the counterpart connector and fitted thereto, whereby the elastic pieces of the adaptor can be deformed in accordance with the position of the counterpart connector to thereby align the position of the connector. Accordingly, the misalignment between the connector and the counterpart connector can be absorbed to make it easy to connect the connector with the counterpart connector. Thus, the efficiency in the connection work can be enhanced. Incidentally, the distal end portion of the connector is generally chamfered. It is therefore possible to fit the distal end portion of the connector to the distal end portion of the counterpart connector only if the distal end portion of the connector is pressed against the distal end of the counterpart connector.

A tapered portion which guides the counterpart connector may be formed in a distal end portion of the connector. With this configuration, the distal end portion of the connector can be smoothly fitted to the counterpart connector.

Specifically, the connector support portion of the wiring board may have a prismatic shape. Correspondingly thereto, the adaptor may have a prismatic shape. The elastic pieces may be formed to be able to contact upper, lower, left and right inner surfaces of the connector support portion, respectively.

An abutment surface which restricts an insertion position of the adaptor may be formed in the inner surface of the connector support portion of the wiring board. With this configuration, the relative position of the connector to the connector support portion is stabilized so that the connector can be surely connected to the counterpart connector. It is therefore possible to enhance elastic reliability.

In another aspect of the invention, an adaptor includes a housing which internally holds a cylindrical connector to be fitted to a counterpart connector formed in an electric component, and which is inserted into and supported by a cylindrical connector support portion formed in a wiring board in which an electric wire to be connected to the connector is arranged, and a plurality of elastic pieces formed on an outer circumferential surface of the housing such that the connector is supported on an inner surface of the connector support portion through the elastic pieces.

According to one or more embodiments of the invention, it is possible to easily perform connection work between each connector supported on a wiring board and each counterpart connector to thereby enhance working efficiency.

DETAILED DESCRIPTION

A connector support structure according to an embodiment of the invention will be described below with reference to FIG. 1 to FIG. 13. Connectors in the embodiment are connected to solenoids, which are electric components disposed in a transmission of a car. Electric signals or power sources from the outside are supplied to the solenoids through the connectors. A fundamental configuration for supporting the connectors will be described below before a structure for retaining the connectors is described specifically.

Figure 1:
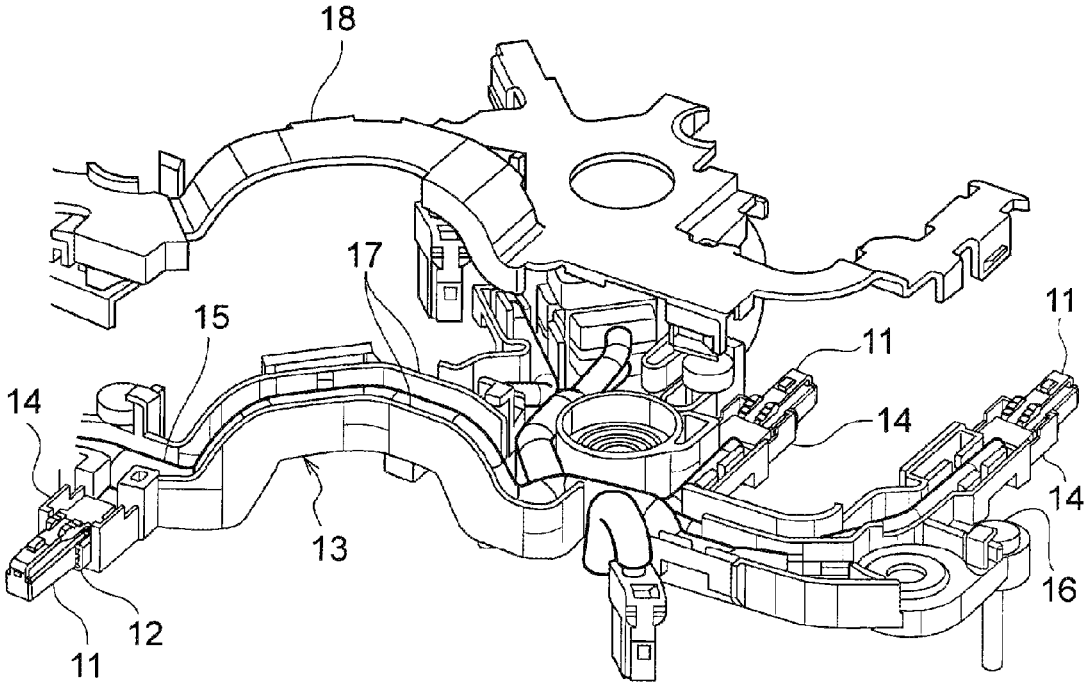
FIG. 1 is a perspective view showing the appearance of a wiring board supporting connectors.

Each connector 11 according to the embodiment is supported by a connector support portion 14 formed in a wiring board 13 in a state where the connector 11 has been attached to an adaptor 12, as shown in FIG. 1.

The wiring board 13 is placed substantially horizontally inside a casing of a not-shown transmission. The wiring board 13 is formed out of insulating resin. The wiring board 13 includes wiring paths (not shown) in which electric wires 15 connected to the connectors 11 are arranged, and a plurality of connector support portions 14 supporting the connectors 11. Bolts 16 inserted into bolt holes are screwed down to constituent components inside the casing so as to fix the wiring board 13 to the casing. The wiring board 13 in the embodiment is formed into a hollow box, as follows. That is, side walls 17 are erected from opposite end portions of each flat wiring path so as to extend in a longitudinal direction thereof. Upper end surfaces of the side walls 17 are covered with a cover 18. The side walls 17 are made to protrude horizontally to form the connector support portions 14 into cylindrical shapes. In FIG. 1, three connector support portions 14 protruding in different directions from one another are depicted. Incidentally, the wiring board 13 may be formed into a plate-like shape without being covered with the cover 18.

Figure 2:
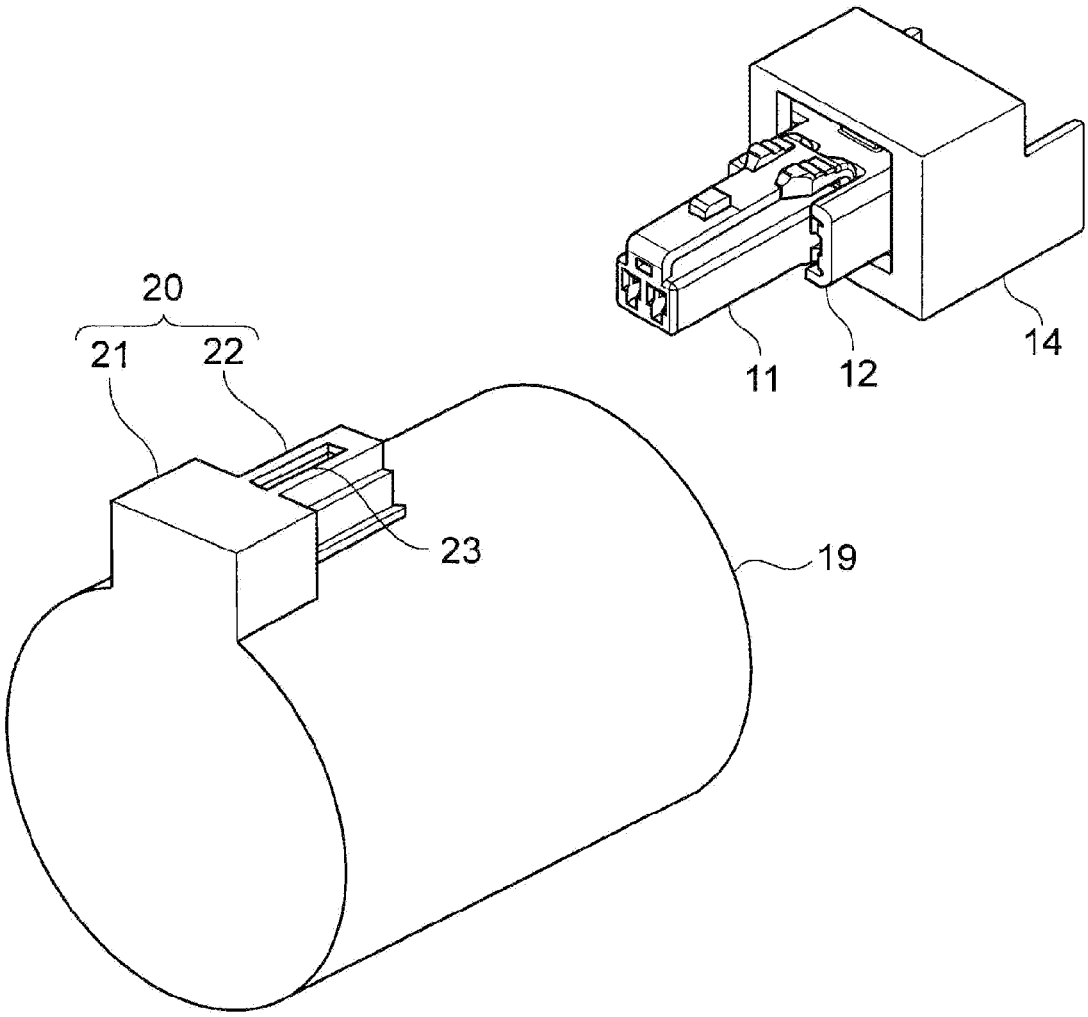
FIG. 2 is a view for explaining an operation in which a connector is connected to a connector portion of a solenoid.

As shown in FIG. 2, columnar solenoids 19 serving as electric components are disposed near the connector support portions 14 of the wiring board 13, respectively. The solenoids 19 correspond to the connectors 11 one to one. The solenoids 19 serve to drive electromagnetic valves of the transmission of the car.

A connector portion 20 made of resin and serving as a counterpart connector to be connected to a connector 11 is provided in the outer circumferential surface of each solenoid 19. The connector portion 20 is formed with a rectangular parallelepiped base portion 21 and a rectangular cylindrical housing 22. An electronic component or the like has been received in the base portion 21. The housing 22 extends from the base portion 21 and in the axial direction of the solenoid 19. The housing 22 is disposed so that an opening at one axial end thereof can face the front end surface of the connector 11 supported by the connector support portion 14 of the wiring board 13. Thus, the connector 11 can be fitted into the opening. A slit portion 23 is provided in the upper surface of the housing 22 so as to penetrate the upper wall of the housing 22. The housing 22 receives a not-shown rod-like terminal extending in parallel to the axial center of the housing 22 so as to constitute a male connector. An electric wire connected to the rod-like terminal is connected to the electric component or the like inside the base portion 21.

Figure 3:
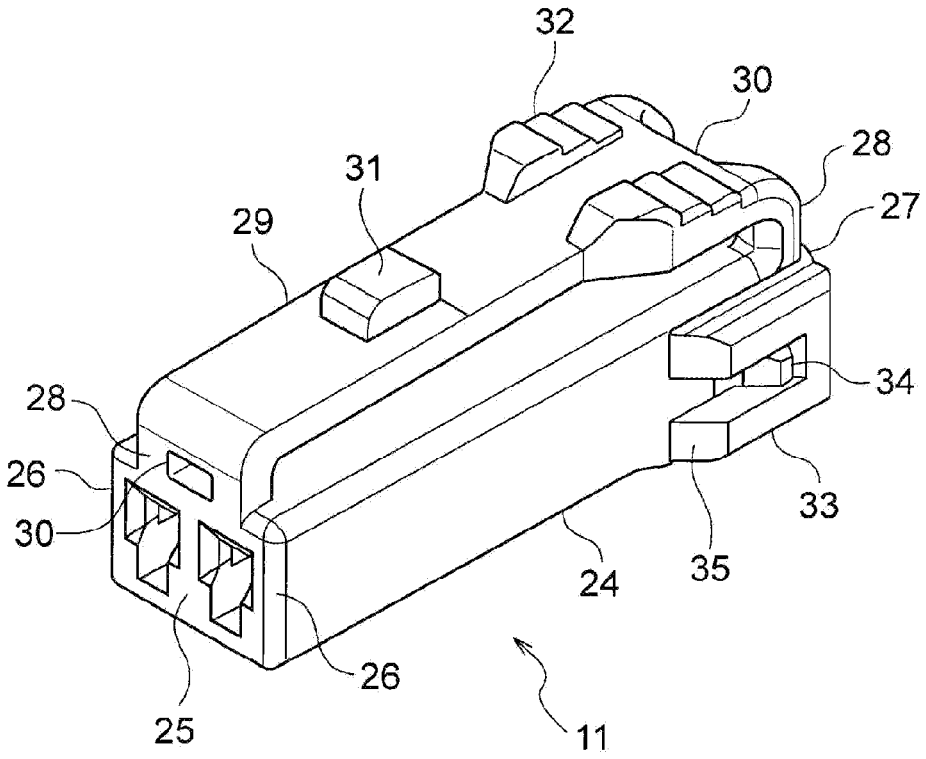
FIG. 3 is a perspective view of the appearance of the connector.

Each connector 11 receives a not-shown terminal in a rectangular cylindrical housing 24 formed out of insulating synthetic resin so as to constitute a female connector, as shown in FIG. 3. A tapered portion 26 inclined toward the opposite side surfaces is formed in a front end surface 25 of the connector 11. When the connector 11 and the connector portion 20 are made close to each other relatively, the tapered portion 26 abuts against the connector portion 20 and guides the connector 11 in a fitting direction. An electric wire connected to the terminal is extracted from the housing 24 and wired in a wiring path of the wiring board 13.

In the connector 11, a pair of belt-like foot portions 28 are erected from the upper portion of the front end surface 25 and the upper portion of a rear end surface 27 on the opposite side to the front end surface 25, respectively. The foot portions 28 are curved into arc shapes and connected to each other to form a belt-like spring body 29 extending axially. Rectangular through holes 30 are formed in the paired foot portions 28, respectively. The spring body 29 is formed to be flexible and deformable vertically. A first protrusion portion 31 protrudes from the upper surface of the spring body 29 near the longitudinal center thereof. A pressing portion 32 for operation to press and deform the spring body 29 protrudes from the upper surface of the spring body 29 on the rear end side thereof. Frame-like protrusions 33 protruding like U-shapes are provided in the opposite side surfaces of the rear end portion of the housing 24, respectively. A second protrusion portion 34 is provided inside each frame-like protrusion 33. The frame-like protrusion 33 is formed to be open in front of the housing 24. In front view, the second protrusion portion 34 is disposed at the heart of the opening of the frame-like protrusion 33. Front end surfaces 35 of the frame-like protrusion 33 and the second protrusion portion 34 are inclined rearward.

Figure 4:
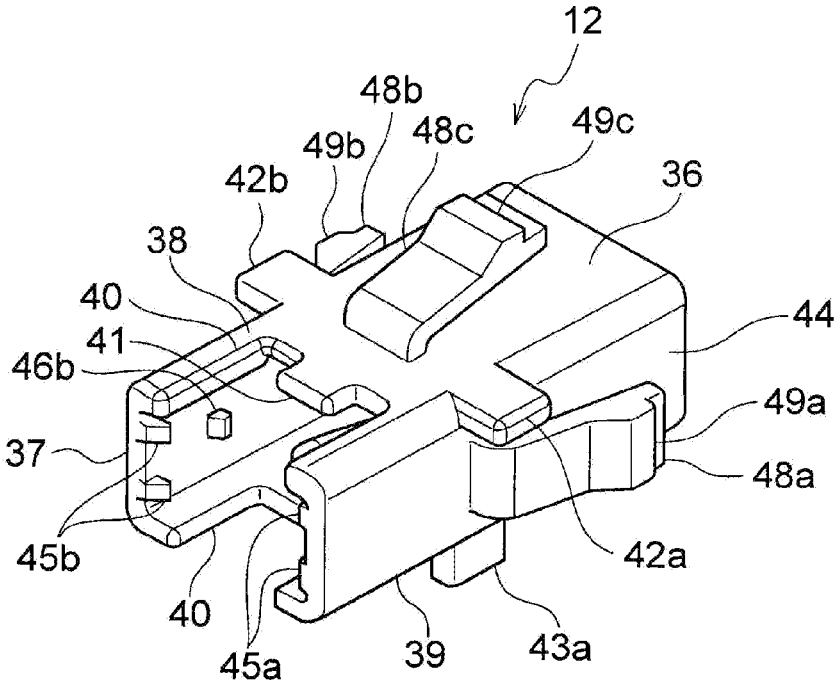
FIG. 4 is a perspective view of the appearance of an adaptor.
Figure 5:
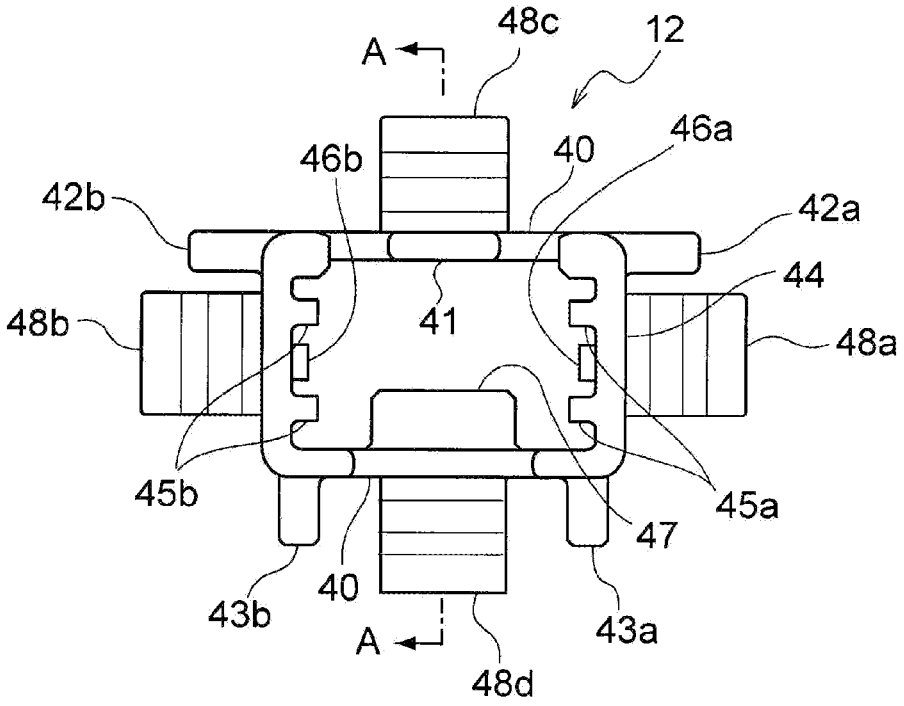
FIG. 5 is a front view of the adaptor.
Figure 6:
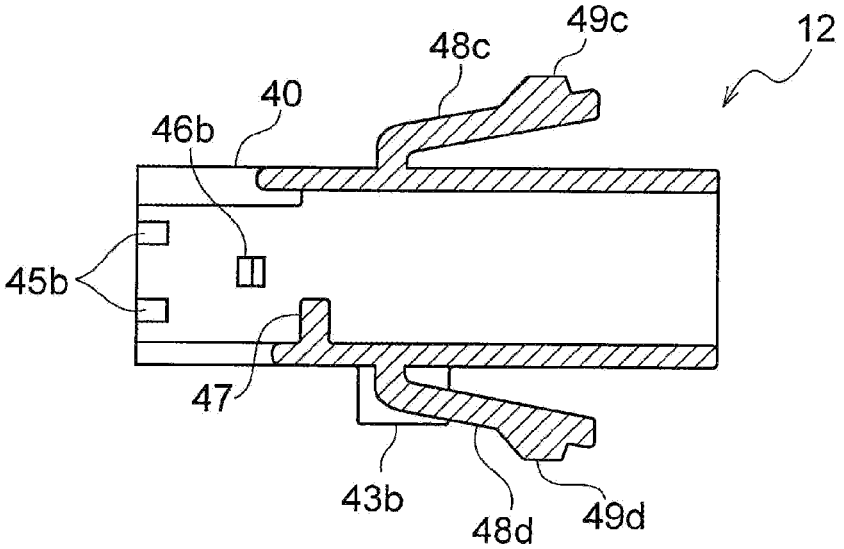
FIG. 6 is a sectional view of the adaptor from the arrow direction A-A in FIG. 5

The adaptor 12 to which the connector 11 is attached is formed out of insulating resin. As shown in FIG. 4 to FIG. 6, the connector 11 is retained inside a rectangular cylindrical housing 36. In the adaptor 12, an upper wall 38 and a lower wall 39 are cut into rectangular shapes to form cut portions 40 from a front end surface 37 of the housing 36 toward the rear end thereof. A protrusion piece 41 protruding frontward is provided in the cut portion 40 of the upper wall 38. A pair of first lock pieces 42*a* and 42*b* and a pair of second lock pieces 43*a* and 43*b* are provided in the axial center portion of the housing 36. The first lock pieces 42*a* and 42*b* protrude to left and right along the upper wall 38. The second lock pieces 43*a* and 43*b* protrude downward from the lower wall 39 so as to leave each other to left and right. A pair of first lock portions 45*a*, 45*b* and a second lock portion 46*a*, 46*b* are provided in each of left and right side walls 44 of the housing 36. The first lock portions 45*a*, 45*b* protrude inward from distal end portions of the housing 36, respectively. The second lock portion 46*a*, 46*b* protrudes inward at the rear of the first lock portions 45*a*, 45*b*. The first lock portions 45*a*, 45*b* are formed to incline their front end surfaces rearward. The second lock portion 46*a*, 46*b* is disposed between the paired first lock portions 45*a*, 45*b* in view from the front of the housing 36. A connector stopper 47 protruding inward is provided in the lower wall 39 of the housing 36.

In the adaptor 12, elastic pieces 48*a* to 48*d* having the same configuration are provided to protrude in the upper wall 38, the lower wall 39 and the left and right side walls 44 of the housing 36, respectively. Each elastic piece 48 is erected substantially perpendicularly from the outer circumferential surface of the housing 36 and then extended to leave the outer circumferential surface gradually toward the rear of the housing 36, that is, to be slanted with respect to the axis of the housing 36. The elastic piece 48 provided thus has a spring property. In rear end portions of the elastic pieces 48*a* to 48*d*, protrusion portions 49*a* to 49*d* are formed to protrude outward and contact with a counterpart member (connector support portion 14). Each protrusion portion 49 is formed to extend in the width direction of each elastic piece 48.

In the adaptor 12 configured thus, the connector 11 is inserted into the housing 36 from its front. In the connector 11 inserted into the housing 36, the left and right frame-like protrusions 33 press the first lock portions 45*a* and 45*b* of the adaptor 12, respectively, to expand the side walls 44 of the housing 36 outward and get over the first lock portions 45*a* and 45*b*. Thus, the left and right second protrusion portions 34 get over the second lock portions 46*a* and 46*b* of the adaptor 12, respectively. The left and right second protrusion portions 34 are engaged with the second lock portions 46*a* and 46*b* so that the connector 11 can be restricted from moving to the opposite direction to the insertion direction. In addition, the rear end surface 27 abuts against the connector stopper 47 of the adaptor 12 so that the connector 11 can be restricted from moving in the insertion direction. Further, the protrusion pieces 41 of the cut portions 40 of the adaptor 12 are inserted into the through holes 30 at the rears of the foot portions 28 of the connector 11, respectively, and the left and right frame-like protrusions 33 are engaged with the inner sides of the left and right side walls 44 putting the cut portions 40 of the adaptor 12 therebetween.

Figure 7:
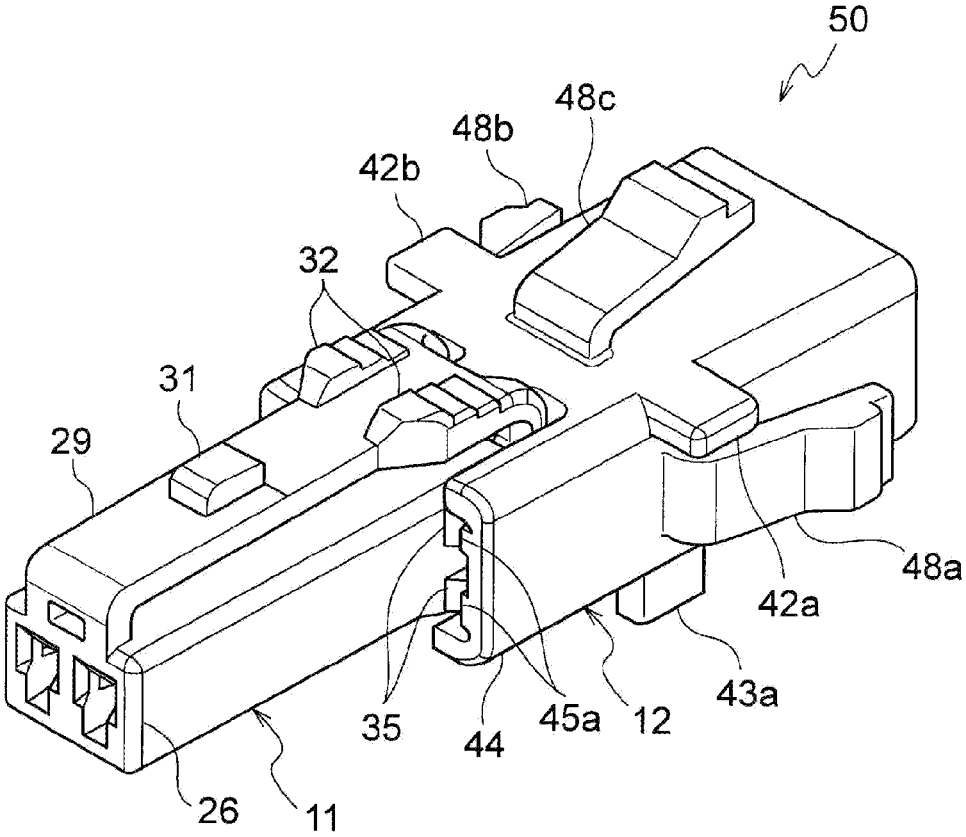
FIG. 7 is a perspective view of the appearance of the adaptor mounted with the connector.

In this manner, the rear end portion of the connector 11 is locked to the adaptor 12 so that the connector 11 can be retained by the adaptor 12 as shown in FIG. 7. In the connector 11 retained by the adaptor 12, the spring body 29 is exposed from the adaptor 12. Therefore, the pressing portion 32 of the spring body 29 can be pressed when the adaptor 12 is fitted to the connector portion 20 of the solenoid 19.

Figure 8:
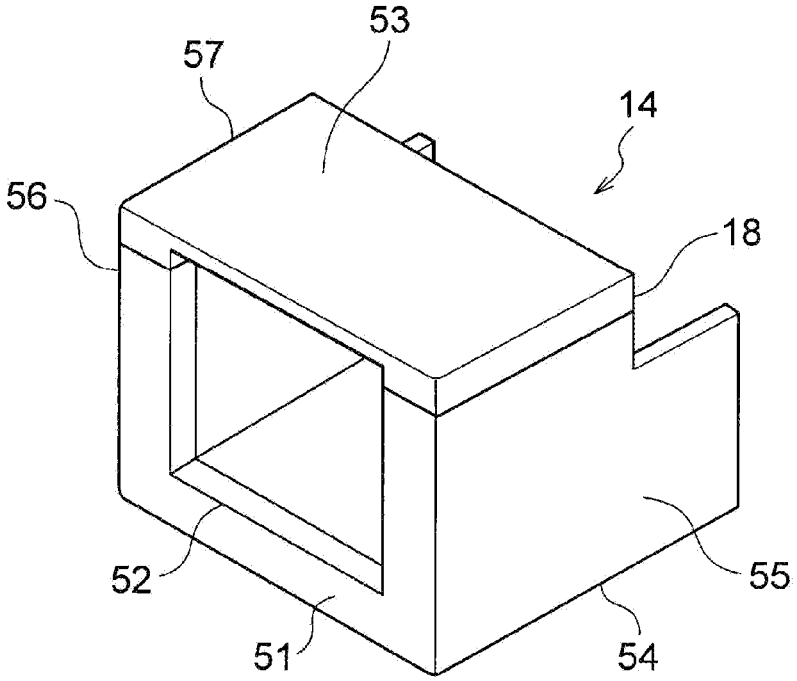
FIG. 8 is a perspective view of the appearance of a connector support portion.
Figure 9:
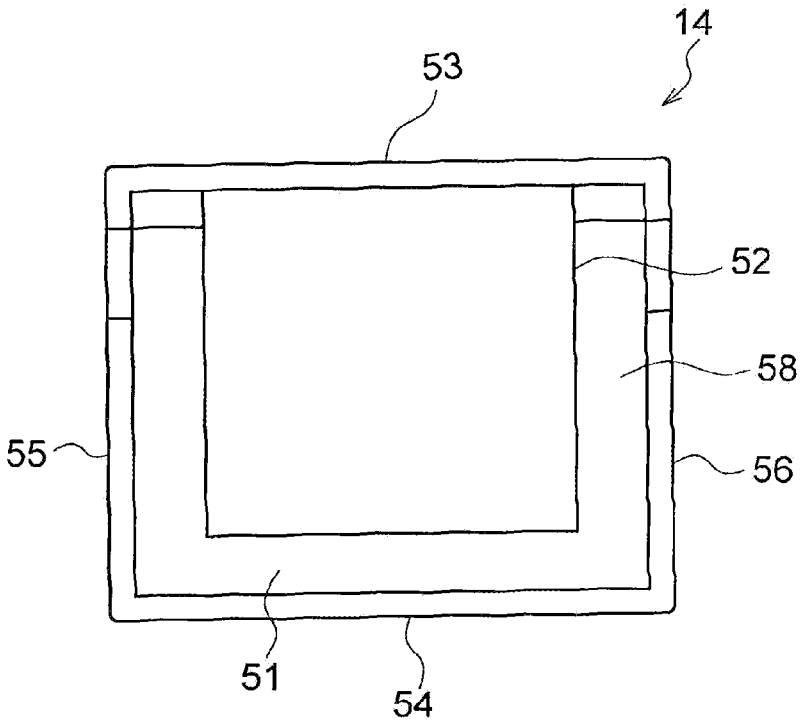
FIG. 9 is a back view of the connector support portion.

The connector 11 attached to the adaptor 12 (hereinafter referred to as assembly body 50 appropriately) is mounted in the connector support portion 14 of the wiring board 13. As shown in FIG. 8 and FIG. 9, the connector support portion 14 is formed into a rectangular cylindrical shape as a whole. The embodiment uses a split structure in which the upper portion of the connector support portion 14 is made of the cover 18. However, the connector support portion 14 and the cover 18 may be formed integrally.

A cylindrical portion 57 is formed in the connector support portion 14 so that the assembly body 50 can be inserted into the cylindrical portion 57 from its back. In the cylindrical portion 57, a rectangular opening 52 is formed inside a front wall 51. The cylindrical portion 57 includes an upper wall 53, a lower wall 54, and left and right walls 55 and 56.

Figure 10:
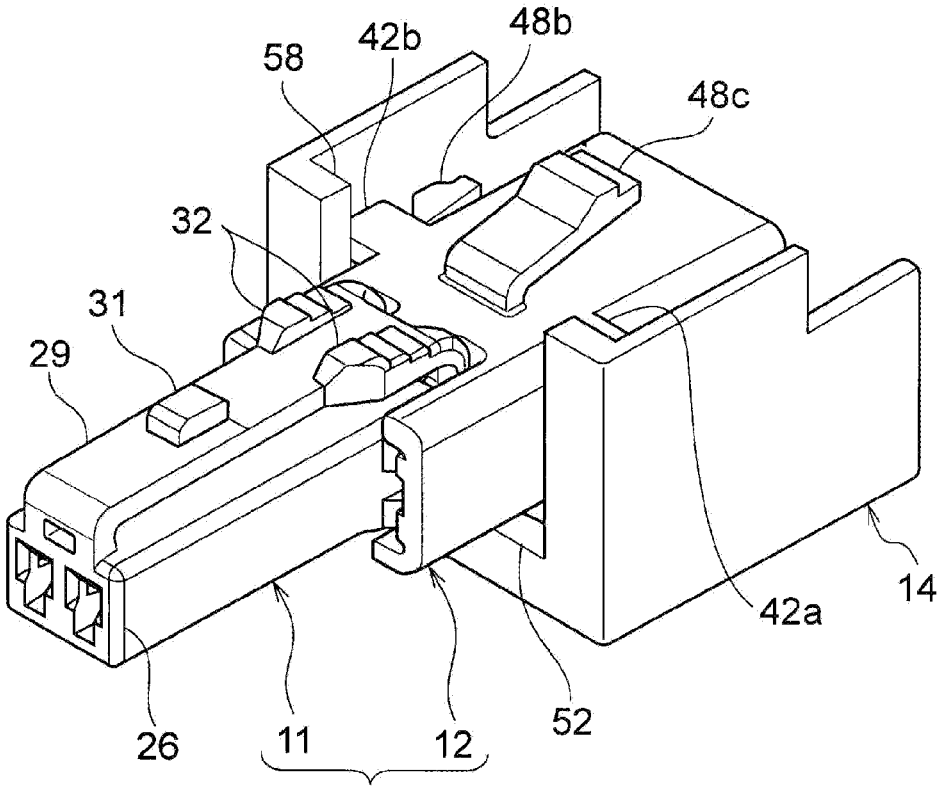
FIG. 10 is a perspective view of the connector support portion mounted with an assembly body.
Figure 11:
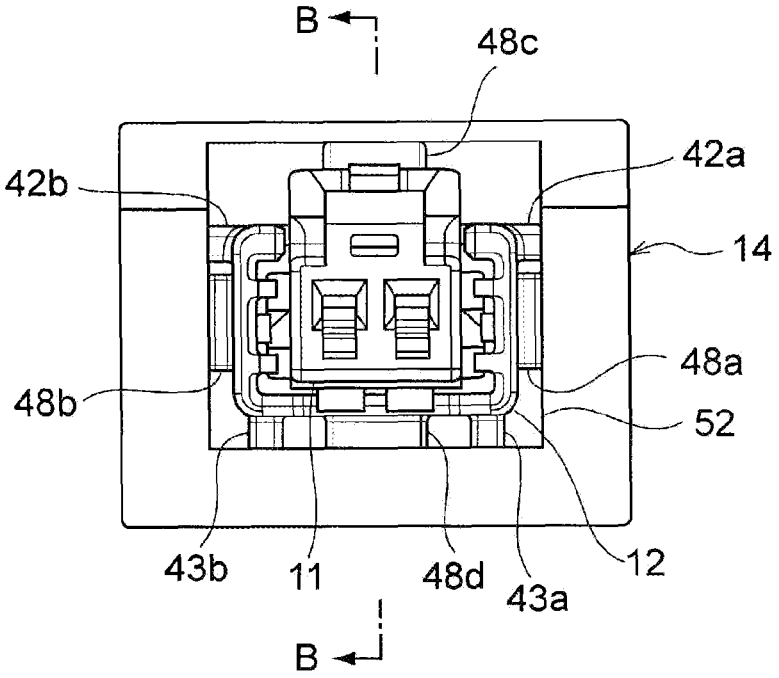
FIG. 11 is a front view of the connector support portion mounted with the assembly body.

As shown in FIG. 10 and FIG. 11, the back surface of the front wall 51 of the connector support portion 14 serves as an abutment surface 58 on which the first lock pieces 42*a* and 42*b* and the second lock pieces 43*a* and 43*b* of the adaptor 12 should abut. When the adaptor 12 abuts against the abutment surface 58, the insertion position of the connector support portion 14 can be restricted. In the assembly body 50 that has been mounted in the connector support portion 14, the distal end side of the adaptor 12 and the connector 11 retained by the adaptor 12 are exposed from the opening 52. Incidentally, the side wall 55 is formed into a step-like shape to open the connector support portion 14 upward on its rear side. Thus, the assembly body 50 can be mounted in the connector support portion 14 from above.

Figure 12:
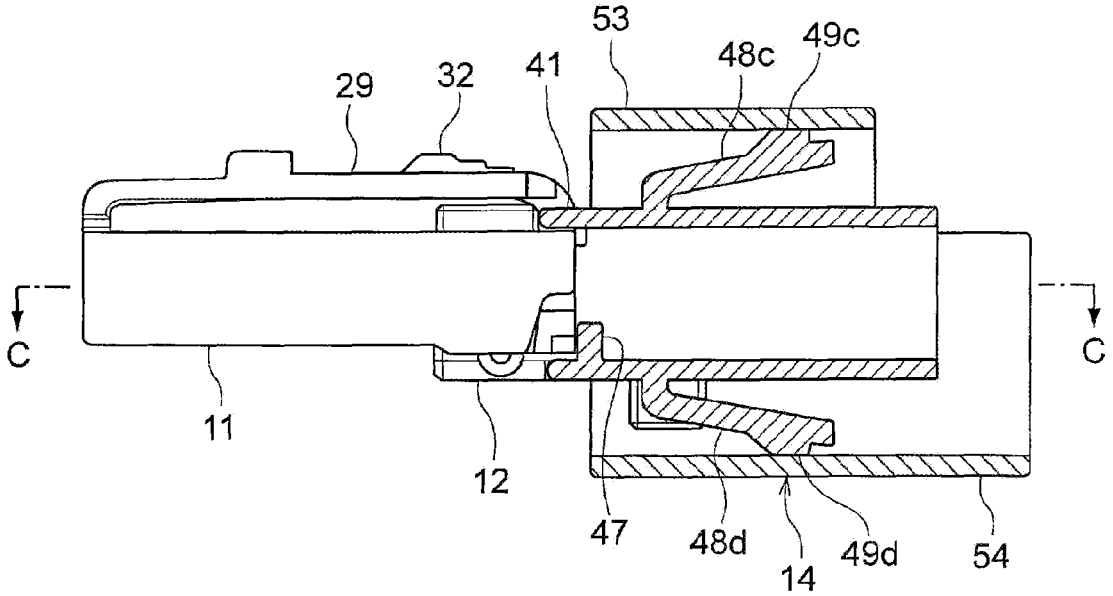
FIG. 12 is a sectional view taken from the arrow direction B-B in FIG. 11.
Figure 13:
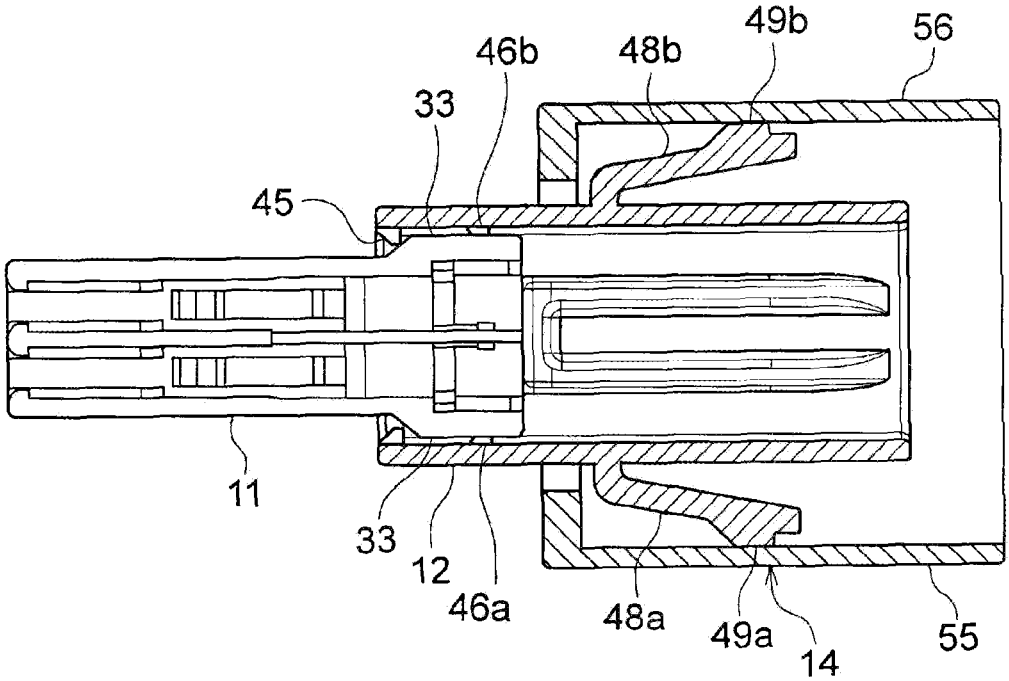
FIG. 13 is a sectional view taken from the arrow direction C-C in FIG. 12.

In the assembly body 50 inserted into the connector support portion 14, as shown in FIG. 12 and FIG. 13, the protrusion portions 49*a* to 49*d* of the respective elastic pieces 48*a* to 48*d* of the adaptor 12 press the inner surfaces of the cylindrical portion 57 opposed thereto, respectively, so that the assembly body 50 can be supported on the inner surfaces. In addition, a gap is provided circumferentially between the inner circumferential surface of the opening 52 of the connector support portion 14 and the outer circumferential surface of the adaptor 12 protruding from the opening 52.

In this manner, the support structure for the connector 11 according to the embodiment includes the connector 11 to be fitted to the connector portion 20 formed in the solenoid 19, the cylindrical connector portion 14 formed in the wiring board 13 in which the electric wire 15 to be connected to the connector 11 is arranged, and the adaptor 12 retaining the connector 11 internally and inserted into and supported by the connector support portion 14. The adaptor 12 supports the connector 11 on the inner surfaces of the connector support portion 14 through the elastic pieces 48*a* to 48*d*.

Due to this configuration, the assembly body 50 inserted into the connector support portion 14 of the wiring board 13, that is, the connector 11 can be bent due to the elastic pieces 48*a* to 48*d* of the adaptor 12 pressing the inner surfaces of the connector support portion 14, respectively. Thus, the connector 11 is supported on the inner surfaces of the connector support portion 14 through the elastic pieces 48*a* to 48*d* so that the connector 11 can be aligned. Since the elastic pieces 48*a* to 48*d* are formed with the same configuration, equivalent repulsion forces are generated vertically and horizontally so that the connector 11 can be aligned relatively to the connector support portion 14 and with the vicinity of the center of the opening 52.

Here, description will be made about an example of procedure in which a wiring board 13 on which a plurality of assembly bodies 50 have been mounted is installed in a casing of a transmission, and connectors 11 of the assembly bodies 50 are connected to connector portions 20 of solenoids 19.

First, the wiring board 13 is placed in a predetermined position within the casing of the transmission. On this occasion, the assembly bodies 50 disposed in the connector support portions 14 of the wiring board 13, respectively, are retracted from their regular insertion positions. The connector portions 20 of the solenoids 19 are disposed near the connector support portions 14, respectively, as shown in FIG. 2.

Next, the assembly bodies 50 mounted in the connector support portions 14 are pushed in with fingers so that the assembly bodies 50 can be moved to contact with the abutment surfaces 58 of the connector support portions 14, respectively. On this occasion, even when the axial center of the housing 22 of each connector 20 is misaligned with the axial center of each connector 11, the tapered portion 26 of the connector 11 abuts against the distal end portion of the housing 22 of the connector portion 20 so that the distal end portion of the connector 11 can be caught by the opening of the housing 22 of the connector portion 20. Thus, the elastic pieces 48*a* to 48*d* are elastically deformed in accordance with the position of the housing 22 so that the axial center of the connector 11 can be displaced (aligned) in accordance with the axial center of the housing 22. As a result, the misalignment is absorbed so that the distal end portion of the connector 11 can be guided into the opening of the housing 22 and fitted into its regular position in the housing 22.

On the other hand, when the distal end portion of the connector 11 is fitted into the opening of the housing 22, the pressing portion 32 of the connector 11 presses and bends the spring body 29. Due to this bending, the first protrusion portion 31 formed in the spring body 29 moves downward, and the first protrusion portion 31 is engaged with the slit portion 23 of the housing 22. The first protrusion portion 31 engaged with the slit portion 23 moves along the slit portion 23.

In this manner, according to the embodiment, misalignment between each connector 11 retained on the wiring board 13 and the connector portion 22 of each solenoid 19 can be absorbed so that the connector 11 can be smoothly fitted into the connector portion 22. That is, the connector 11 can be fitted into the connector portion 22 only by a simple operation in which the assembly body 50 is slid along the connector portion 14.

Incidentally, a plurality of connector support portions 14 are provided with difference axial centers from one another in the wiring board 13 according to the embodiment. Accordingly, description has been made about an example in which each assembly body is slid relatively to a corresponding one of the connector support portions 14. However, when the axial centers of the connector support portions 14 are, for example, parallel to one another, the connectors 11 may be connected to the connector portions 22 in the state where the assembly bodies 50 have been retained in their regular insertion positions of the connector support portions 14, respectively.

Although the embodiment of the invention has been described above in detail with reference to the drawings, the embodiment is merely an example of the invention. The embodiment may be changed or modified within the scope of the claims.

For example, although the embodiment has been described about the example in which each connector support portion 14 supporting each assembly body 50 is formed with a cylindrical portion 57 having a rectangular cylindrical shape, the cylindrical portion 57 is not limited to the rectangular cylindrical shape but may be formed into a circular cylindrical shape as long as the cylindrical portion 57 can surround the external surface of the adaptor 12 and includes inner surfaces on which the elastic pieces 48*a* to 48*d* can abut, respectively.

In addition, although the embodiment has described along the example in which four elastic pieces 48*a* to 48*d* extending to upper, lower, left and right are provided in the external surface of the adaptor 12, the number of elastic pieces 48 is not limited to four. For example, when the cylindrical portion 57 of the connector support portion 14 is formed into a circular cylindrical shape, three elastic pieces may be provided at an equal interval around the axis of the adaptor 12.

In addition, although the embodiment has been described along the example in which the connector portion 20 formed in the solenoid 19 is used as a counterpart connector to which the connector 11 should be connected, it is a matter of course that the connector support structure according to the invention is not limited to the case where the connector 11 is connected to the connector portion 20 of the solenoid 19 but may be applied to a case where the connector 11 is connected to a connector of any electric component.

What is claimed is:

1. A connector support structure comprising:

a connector to be fitted to a counterpart connector formed in an electric component;

a connector support portion formed in a wiring board in which an electric wire to be connected to the connector is arranged; and a resin adaptor which holds the connector internally and which is inserted into and supported by the connector support portion, wherein the adaptor comprises a plurality of elastic pieces in an outer circumferential surface of the adapter such that the connector is supported on an inner surface of the connector support portion through the plurality of elastic pieces, and wherein the plurality of elastic pieces of the adapter are formed to be able to contact upper, lower, left and right inner surfaces of the connector support portion, respectively.

2. The connector support structure according to claim 1, wherein the connector support portion of the wiring board has a prismatic shape.

3. The connector support structure according to claim 1, wherein an abutment surface which restricts an insertion position of the adaptor is formed in the inner surface of the connector support portion of the wiring board.

4. An adaptor comprising:

a housing which internally holds a connector to be fitted to a counterpart connector formed in an electric component, and which is inserted into and supported by a connector support portion formed in a wiring board in which an electric wire to be connected to the connector is arranged; and a plurality of elastic pieces formed on an outer circumferential surface of the housing such that the connector is supported on an inner surface of the connector support portion through the plurality of elastic pieces, wherein the plurality of elastic pieces of the adapter are formed to be able to contact upper, lower, left and right inner surfaces of the connector support portion, respectively.

* * * * *